US010530055B2

(12) United States Patent
Tsai

(10) Patent No.: US 10,530,055 B2
(45) Date of Patent: Jan. 7, 2020

(54) COMMUNICATION DEVICE

(71) Applicant: Quanta Computer Inc., Taoyuan (TW)

(72) Inventor: Ming-Che Tsai, Taoyuan (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 24 days.

(21) Appl. No.: 15/860,999

(22) Filed: Jan. 3, 2018

(65) Prior Publication Data

US 2019/0148830 A1 May 16, 2019

(30) Foreign Application Priority Data

Nov. 16, 2017 (TW) ..... 106139668 A

(51) Int. Cl.

| | |
|---|---|
| ***H01Q 1/38*** | (2006.01) |
| ***H01Q 5/28*** | (2015.01) |
| ***H01Q 9/28*** | (2006.01) |
| ***H01Q 1/22*** | (2006.01) |
| ***H01Q 5/35*** | (2015.01) |
| ***H01Q 5/45*** | (2015.01) |
| ***H01Q 9/40*** | (2006.01) |
| ***H01Q 21/28*** | (2006.01) |
| ***H01Q 1/00*** | (2006.01) |

(52) U.S. Cl.

CPC ..... *H01Q 5/28* (2015.01); *H01Q 1/007* (2013.01); *H01Q 1/2283* (2013.01); *H01Q 1/2291* (2013.01); *H01Q 1/38* (2013.01); *H01Q 5/35* (2015.01); *H01Q 5/45* (2015.01); *H01Q 9/285* (2013.01); *H01Q 9/40* (2013.01); *H01Q 21/28* (2013.01)

(58) Field of Classification Search

CPC ..... H01Q 1/32; H01Q 1/42

See application file for complete search history.

(56) References Cited

U.S. PATENT DOCUMENTS 6,433,749 B1 * 8/2002 Thompson ..... H01Q 1/1271 343/700 MS 2005/0093752 A1 5/2005 Cheng et al.

2013/0314291 A1 * 11/2013 Franzon ..... H01Q 21/205 343/795

FOREIGN PATENT DOCUMENTS

CN 106935971 A 7/2017

OTHER PUBLICATIONS

Chinese language office action dated May 23, 2018, issued in application No. TW 106139668.

* cited by examiner

*Primary Examiner* — Graham P Smith

(74) *Attorney, Agent, or Firm* — McClure, Qualey & Rodack, LLP

(57) ABSTRACT

A communication device includes a dielectric substrate, a housing, a first antenna, a second antenna, a third antenna, a fourth antenna, a fifth antenna, a sixth antenna, a seventh antenna, and an eighth antenna. The dielectric substrate has a top surface and a bottom surface. The housing has an outer surface and an inner surface. The first antenna and the third antenna are disposed on the top surface of the dielectric substrate. The second antenna and the fourth antenna are disposed on the bottom surface of the dielectric substrate. The fifth antenna, the sixth antenna, the seventh antenna, and the eighth antenna are disposed on the inner surface of the housing.

11 Claims, 5 Drawing Sheets

COMMUNICATION DEVICE

CROSS REFERENCE TO RELATED APPLICATIONS

This Application claims priority of Taiwan Patent Application No. 106139668 filed on Nov. 16, 2017, the entirety of which is incorporated by reference herein.

BACKGROUND OF THE INVENTION

Field of the Invention

The disclosure generally relates to a communication device, and more particularly, it relates to a small-size, dual-band communication device for supporting MIMO (Multi-Input and Multi-Output) functions.

Description of the Related Art

With the advancements being made in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Wireless access points are indispensable elements that allow mobile devices in a room to connect to the Internet at high speeds. However, since indoor environments have serious problems with signal reflection and multipath fading, wireless access points should process signals with different frequencies from a variety of directions simultaneously. Accordingly, it has become a critical challenge for antenna designers to design a multiband, omnidirectional antenna for use in the limited space of a wireless access point.

BRIEF SUMMARY OF THE INVENTION

In an exemplary embodiment, the disclosure is directed to a communication device including a dielectric substrate, a housing, a first antenna, a second antenna, a third antenna, a fourth antenna, a fifth antenna, a sixth antenna, a seventh antenna, and an eighth antenna. The dielectric substrate has a top surface and a bottom surface. The housing has an outer surface and an inner surface. The first antenna and the third antenna are disposed on the top surface of the dielectric substrate. The second antenna and the fourth antenna are disposed on the bottom surface of the dielectric substrate. The fifth antenna, the sixth antenna, the seventh antenna, and the eighth antenna are disposed on the inner surface of the housing.

In some embodiments, the first antenna, the second antenna, the third antenna, and the fourth antenna cover a first frequency band from 2400 MHz to 2500 MHz. The fifth antenna, the sixth antenna, the seventh antenna, and the eighth antenna cover a second frequency band from 5150 MHz to 5850 MHz.

In some embodiments, the dielectric substrate substantially has a square shape.

In some embodiments, the first antenna, the second antenna, the third antenna, and the fourth antenna are respectively positioned at four sides of the dielectric substrate.

In some embodiments, the housing includes a first side wall, a second side wall, a third side wall, and a fourth side wall. The dielectric substrate is surrounded by the first side wall, the second side wall, the third side wall, and the fourth side wall.

In some embodiments, the first side wall is adjacent to the first antenna. The fifth antenna is disposed on an inner side surface of the first side wall.

In some embodiments, the second side wall is adjacent to the second antenna.

In some embodiments, the third side wall is adjacent to the third antenna. The eighth antenna is disposed on an inner side surface of the third side wall.

In some embodiments, the fourth side wall is adjacent to the fourth antenna. The sixth antenna and the seventh antenna are disposed on an inner side surface of the fourth side wall.

In some embodiments, the seventh antenna is substantially positioned at a corner junction between the third side wall, the fourth side wall, and the dielectric substrate.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
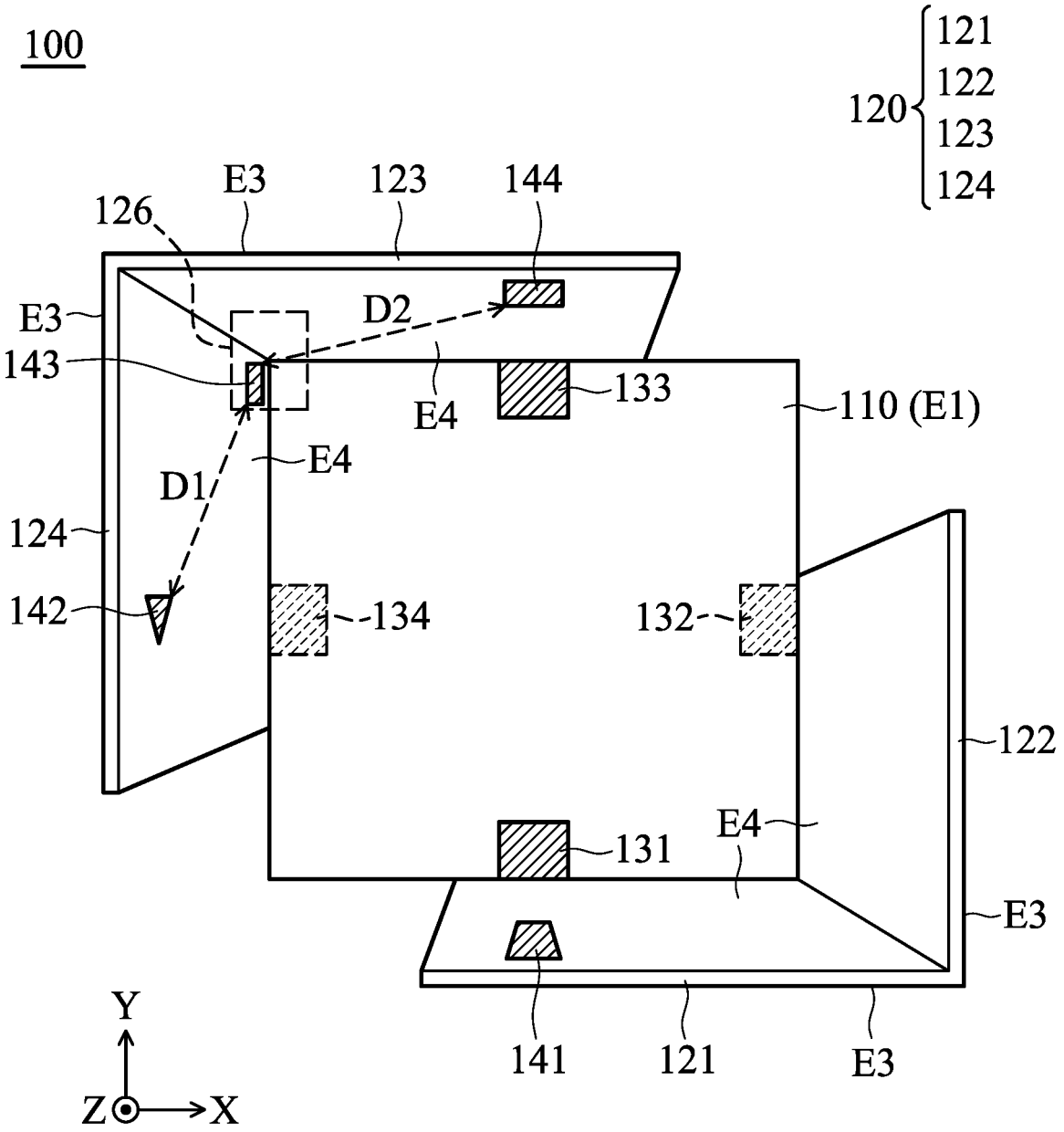
FIG. 1A is a perspective view of a communication device according to an embodiment of the invention.
Figure 1B:
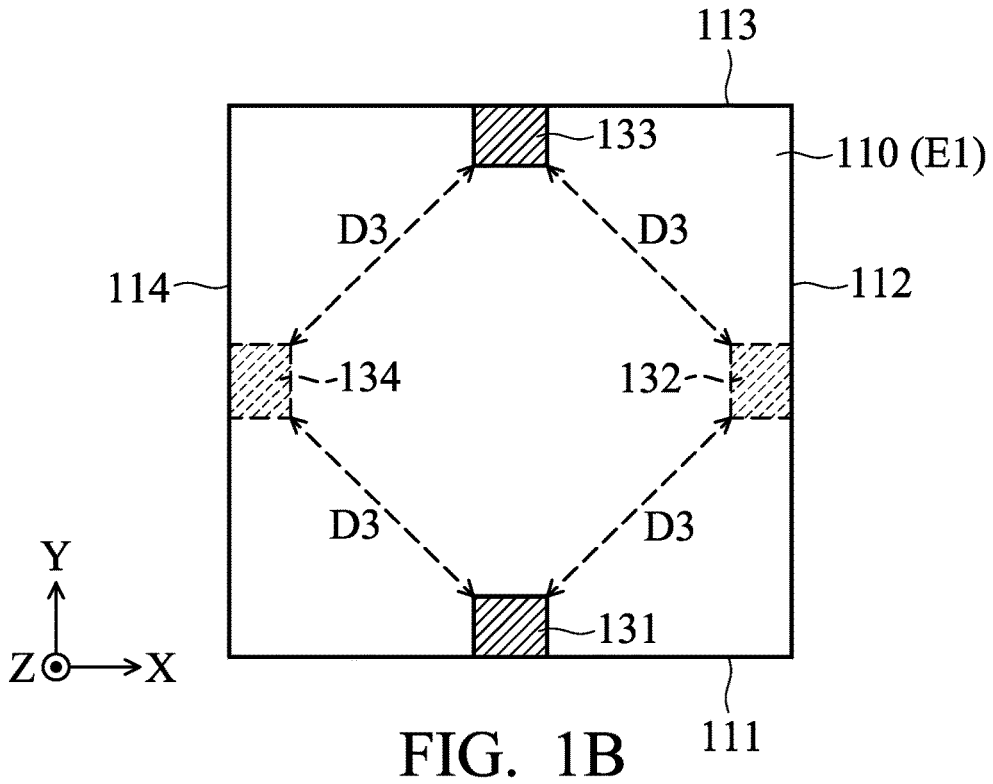
FIG. 1B is a top view of a dielectric substrate according to an embodiment of the invention.
Figure 1C:
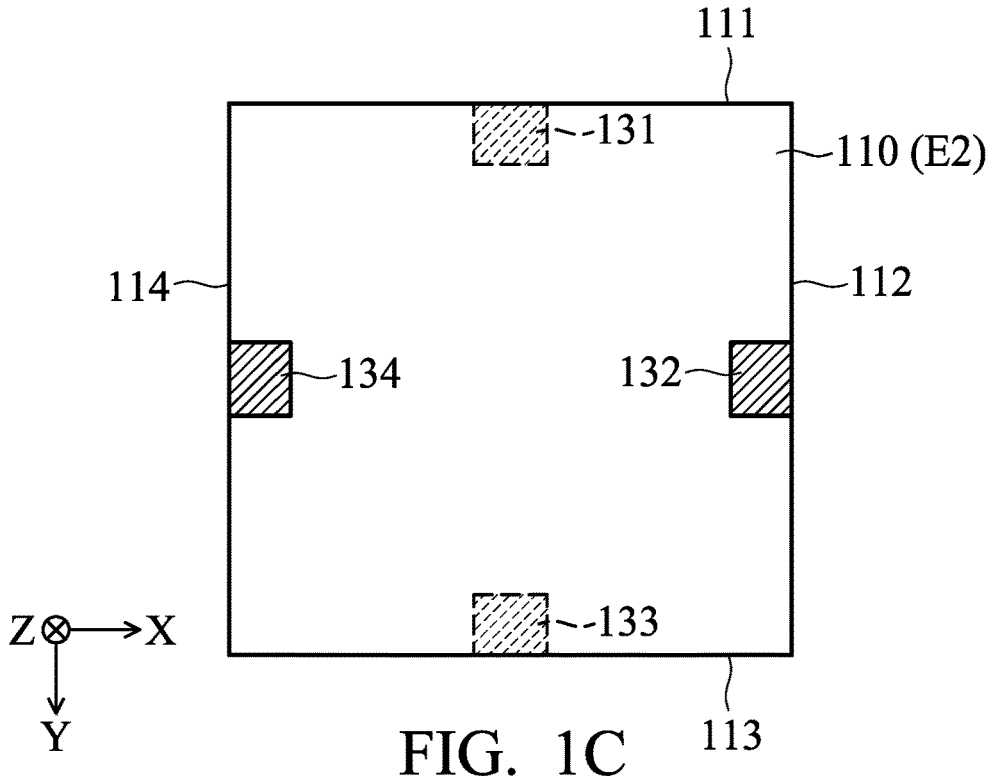
FIG. 1C is a back view of a dielectric substrate according to an embodiment of the invention.

FIG. 1A is a perspective view of a communication device 100 according to an embodiment of the invention. For example, the communication device 100 may be a wireless access point or a router. In the embodiment of FIG. 1A, the communication device 100 includes a dielectric substrate 110, a housing 120, a first antenna 131, a second antenna 132, a third antenna 133, a fourth antenna 134, a fifth antenna 141, a sixth antenna 142, a seventh antenna 143, and an eighth antenna 144. FIG. 1B is a top view of the dielectric substrate 110 according to an embodiment of the invention. FIG. 1C is a back view of the dielectric substrate 110 according to an embodiment of the invention. Please refer to FIG. 1A, FIG. 1B, and FIG. 1C together, so as to understand the invention. It should be noted that the communication device 100 may further include other components, such as a signal processor, a power supply module, and an RF (Radio Frequency) module, although they are not displayed in FIG. 1A, FIG. 1B, and FIG. 1C.

The dielectric substrate 110 may be a PCB (Printed Circuit Board) or an FR4 (Flame Retardant 4) substrate. The dielectric substrate 110 has a top surface E1 and a bottom surface E2, which are opposite to each other. The housing 120 may be made of a nonconductive material, such as a PC (Polycarbonate) material. The housing 120 has an outer surface E3 and an inner surface E4. The outer surface E3 means a device outer-side surface, which can be directly observed by eyes of a user. The inner surface E4 means a device inner-side surface, which cannot be observed by eyes of the user. The dielectric substrate 110 is disposed inside the housing 120 and is adjacent to the inner surface E4 of the housing 120. It should be noted that the term "adjacent" or "close" throughout the disclosure means that the distance (spacing) between two corresponding elements is smaller than a predetermined distance (e.g., 2 mm or shorter), or that the two corresponding elements touch each other directly (i.e., the aforementioned distance/spacing therebetween is reduced to 0). Furthermore, the terms "top", "bottom", "inner", and "outer" throughout the disclosure describe the relative positions between the corresponding elements, and they do not refer to any specific or fixed directions.

In some embodiments, the dielectric substrate 110 substantially has a square shape, and the housing 120 includes a first side wall 121, a second side wall 122, a third side wall 123, and a fourth side wall 124. The dielectric substrate 110 is surrounded by the first side wall 121, the second side wall 122, the third side wall 123, and the fourth side wall 124. The first side wall 121 may be at least partially connected to the second side wall 122. The third side wall 123 may be at least partially connected to the fourth side wall 124. In addition, each of the first side wall 121, the second side wall 122, the third side wall 123, and the fourth side wall 124 may be substantially perpendicular to the dielectric substrate 110. Specifically, the dielectric substrate 110 has a first side 111, a second side 112, a third side 113, and a fourth side 114. The first side wall 121, the second side wall 122, the third side wall 123, and the fourth side wall 124 of the housing 120 are adjacent to the first side 111, the second side 112, the third side 113, and the fourth side 114 of the dielectric substrate 110, respectively. In alternative embodiments, the shapes of the dielectric substrate 110 and the housing 120 are adjustable according to different requirements. For example, the dielectric substrate 110 may substantially have a rectangular shape or an irregular shape, and the housing 120 may have a different shape corresponding to the dielectric substrate 110. It should be understood that although the first side wall 121 and the second side wall 122 are separate from the third side wall 123 and the fourth side wall 124 in FIG. 1A, the first side wall 121 may be connected to the fourth side wall 124 and the second side wall 122 may be connected to the third side wall 123 in alternative embodiments, such that the aforementioned four side walls form a closed-loop shape for surrounding the dielectric substrate 110. In addition, the housing 120 may further include a top cover element and a bottom cover element, so as to form a closed hollow cube (not shown), and the dielectric substrate 110 may be positioned inside the closed hollow cube.

Each of the first antenna 131, the second antenna 132, the third antenna 133, and the fourth antenna 134 can cover a first frequency band from 2400 MHz to 2500 MHz. Each of the fifth antenna 141, the sixth antenna 142, the seventh antenna 143, and the eighth antenna 144 can cover a second frequency band from 5150 MHz to 5850 MHz. Accordingly, the communication device 100 is capable of supporting at least the dual-band operations of WLAN (Wireless Local Area Network) 2.4 GHz/5 GHz. Such a 4×4 MIMO (Multi-input and Multi-Output) antenna design effectively increases the data transmission rate of the communication device 100. It should be understood that the ranges of the first frequency band and the second frequency band are adjustable according to different requirements.

The shapes and types of the first antenna 131, the second antenna 132, the third antenna 133, and the fourth antenna 134 are not limited in the invention. For example, each of the first antenna 131, the second antenna 132, the third antenna 133, and the fourth antenna 134 may be a chip antenna. To reduce the interference between antennas, the first antenna 131 and the third antenna 133 are disposed on (or printed on) the top surface E1 of the dielectric substrate 110, and the second antenna 132 and the fourth antenna 134 are disposed on (or printed on) the bottom surface E2 of the dielectric substrate 110. For example, the first antenna 131 and the third antenna 133 may be positioned at two opposite edges of the top surface E1 of the dielectric substrate 110, and the second antenna 132 and the fourth antenna 134 may be positioned at two opposite edges of the bottom surface E2 of the dielectric substrate 110. Specifically, the first antenna 131, the second antenna 132, the third antenna 133, and the fourth antenna 134 may be substantially positioned at corresponding central points of the first side 111, the second side 112, the third side 113, and the fourth side 114 of the dielectric substrate 110, respectively. Accordingly, the first side wall 121, the second side wall 122, the third side wall 123, and the fourth side wall 124 of the housing 120 may be adjacent to the first antenna 131, the second antenna 132, the third antenna 133, and the fourth antenna 134, respectively. In some embodiments, the first antenna 131, the second antenna 132, the third antenna 133, and the fourth antenna 134 are substantially positioned at four vertices of a diamond shape, respectively. In some embodiments, the shortest distance D3 between any two of the first antenna 131, the second antenna 132, the third antenna 133, and the fourth antenna 134 is at least 50 mm, so as to enhance the isolation between the antennas.

The shapes and types of the fifth antenna 141, the sixth antenna 142, the seventh antenna 143, and the eighth antenna 144 are not limited in the invention. For example, each of the fifth antenna 141, the sixth antenna 142, the seventh antenna 143, and the eighth antenna 144 may be made of a conductive material, such as a metal piece. To improve the device appearance, the fifth antenna 141, the sixth antenna 142, the seventh antenna 143, and the eighth antenna 144 are all disposed on the inner surface E4 of the housing 120. In other words, the fifth antenna 141, the sixth antenna 142, the seventh antenna 143, and the eighth antenna 144 are built-in antennas, instead of external antennas, and they cannot be directly observed by a user. Such a design helps to minimize the total size of the communication device 100.

Figure 2:
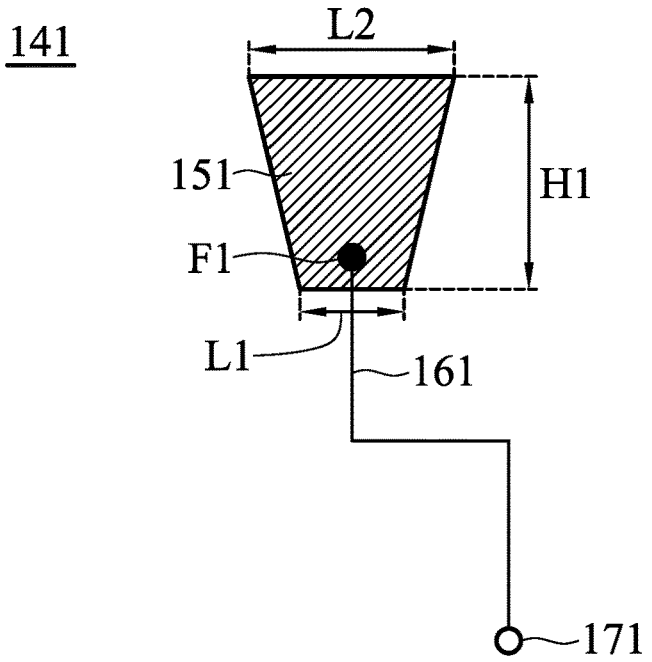
FIG. 2 is a diagram of a fifth antenna according to an embodiment of the invention.

FIG. 2 is a diagram of the fifth antenna 141 according to an embodiment of the invention. Please refer to FIG. 1A and FIG. 2 together. The fifth antenna 141 is disposed on an inner side surface of the first side wall 121 (i.e., the inner surface E4 of the housing 120). For example, the fifth antenna 141 may be substantially positioned above the first antenna 131, and the distance between the fifth antenna 141 and the first antenna 131 may be at least 50 mm. In the embodiment of FIG. 2, the fifth antenna 141 includes a first radiation element 151, a first connection line 161, and a first connector 171. The first radiation element 151 may be a trapezoidal metal piece. A first feeding point F1 may be substantially positioned at a shorter parallel side of the trapezoidal metal piece. The first connection line 161 may be a coaxial cable. The first connector 171 may be an IPEX connector. The first feeding point F1 of the first radiation element 151 may be coupled through the first connection line 161 and the first connector 171 to metal traces on the dielectric substrate 110, so as to receive a feeding signal. With regard to element sizes, the length L1 of the shorter parallel side of the first radiation element 151 may be about 2.9 mm, the length L2 of the longer parallel side of the first radiation element 151 may be about 3.7 mm, the height H1 of the first radiation element 151 may be about 6 mm, and the length of the first connection line 161 may be from about 35 mm to about 50 mm.

Figure 3:
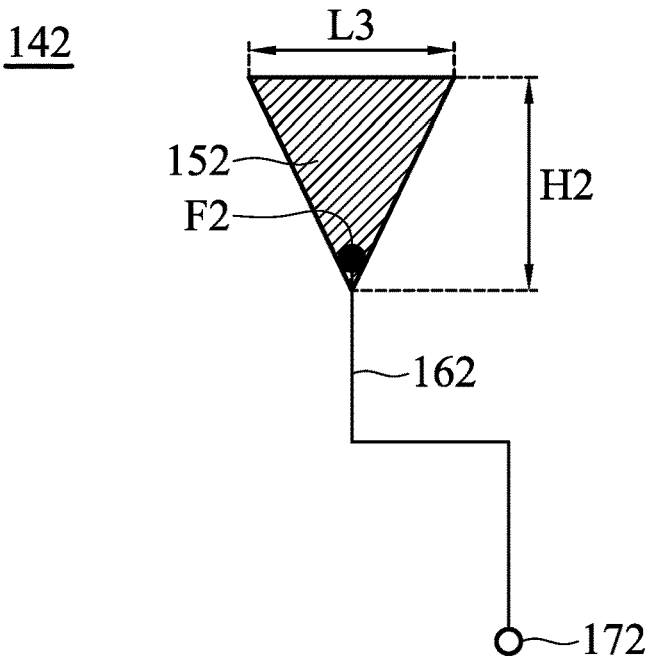
FIG. 3 is a diagram of a sixth antenna according to an embodiment of the invention.

FIG. 3 is a diagram of the sixth antenna 142 according to an embodiment of the invention. Please refer to FIG. 1A and FIG. 3 together. The sixth antenna 142 is disposed on an inner side surface of the fourth side wall 124 (i.e., the inner surface E4 of the housing 120). For example, the sixth antenna 142 may be substantially positioned above the fourth antenna 134, and the distance between the sixth antenna 142 and the fourth antenna 134 may be at least 50 mm. In the embodiment of FIG. 3, the sixth antenna 142 includes a second radiation element 152, a second connection line 162, and a second connector 172. The second radiation element 152 may be an isosceles triangular metal piece. A second feeding point F2 may be substantially positioned at a common vertex of the isosceles triangular metal piece. The second connection line 162 may be a coaxial cable. The second connector 172 may be an IPEX connector. The second feeding point F2 of the second radiation element 152 may be coupled through the second connection line 162 and the second connector 172 to metal traces on the dielectric substrate 110, so as to receive a feeding signal. With regard to element sizes, the length L3 of the top side of the second radiation element 152 may be about 3.4 mm, the height H2 of the second radiation element 152 may be about 6 mm, and the length of the second connection line 162 may be from about 35 mm to about 50 mm.

Figure 4:
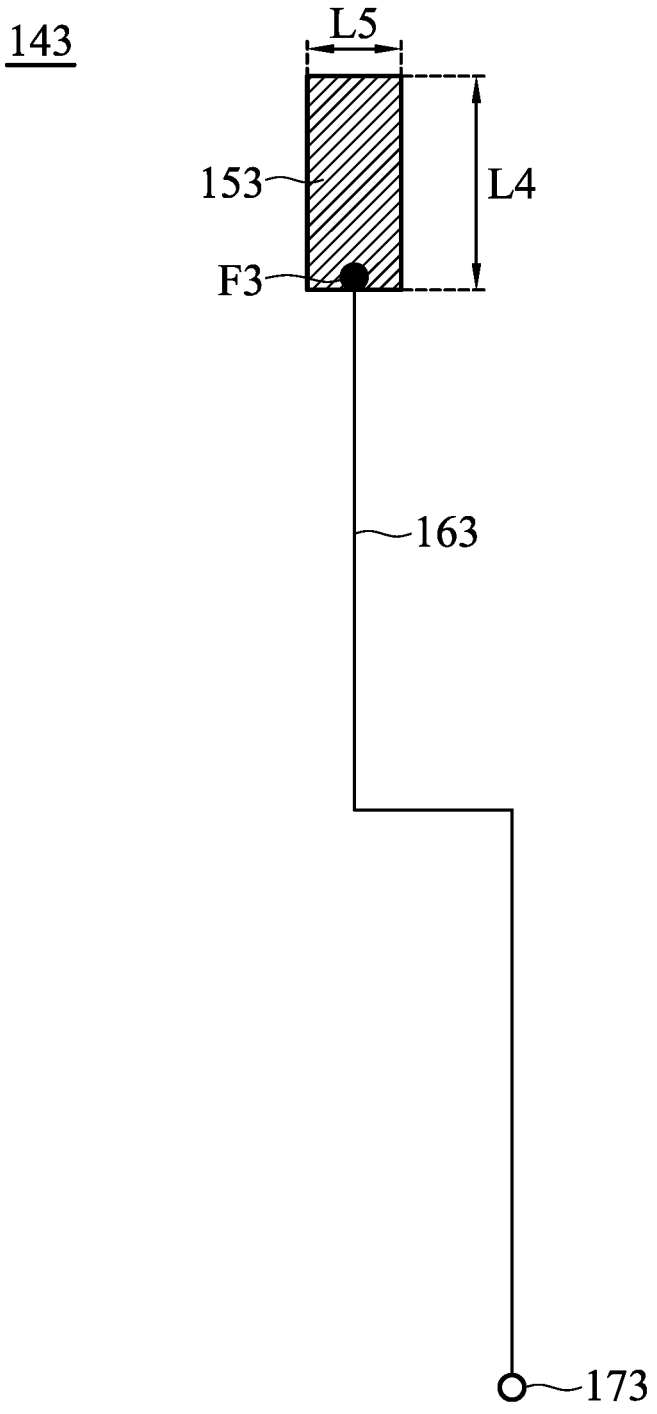
FIG. 4 is a diagram of a seventh antenna according to an embodiment of the invention.

FIG. 4 is a diagram of the seventh antenna 143 according to an embodiment of the invention. Please refer to FIG. 1A and FIG. 4 together. The seventh antenna 143 is disposed on an inner side surface of the fourth side wall 124 (i.e., the inner surface E4 of the housing 120). Specifically, the seventh antenna 143 is substantially positioned at a corner junction 126 between the third side wall 123, the fourth side wall 124, and the dielectric substrate 110. In the embodiment of FIG. 4, the seventh antenna 143 includes a third radiation element 153, a third connection line 163, and a third connector 173. The third radiation element 153 may be a rectangular metal piece. A third feeding point F3 may be substantially positioned at a shorter side of the rectangular metal piece. The third connection line 163 may be a coaxial cable. The third connector 173 may be an IPEX connector. The third feeding point F3 of the third radiation element 153 may be coupled through the third connection line 163 and the third connector 173 to metal traces on the dielectric substrate 110, so as to receive a feeding signal. With regard to element sizes, the length L4 of the longer side of the third radiation element 153 may be about 6.2 mm, the length L5 of the shorter side of the third radiation element 153 may be about 1.6 mm, and the length of the third connection line 163 may be from about 65 mm to about 75 mm.

Figure 5:
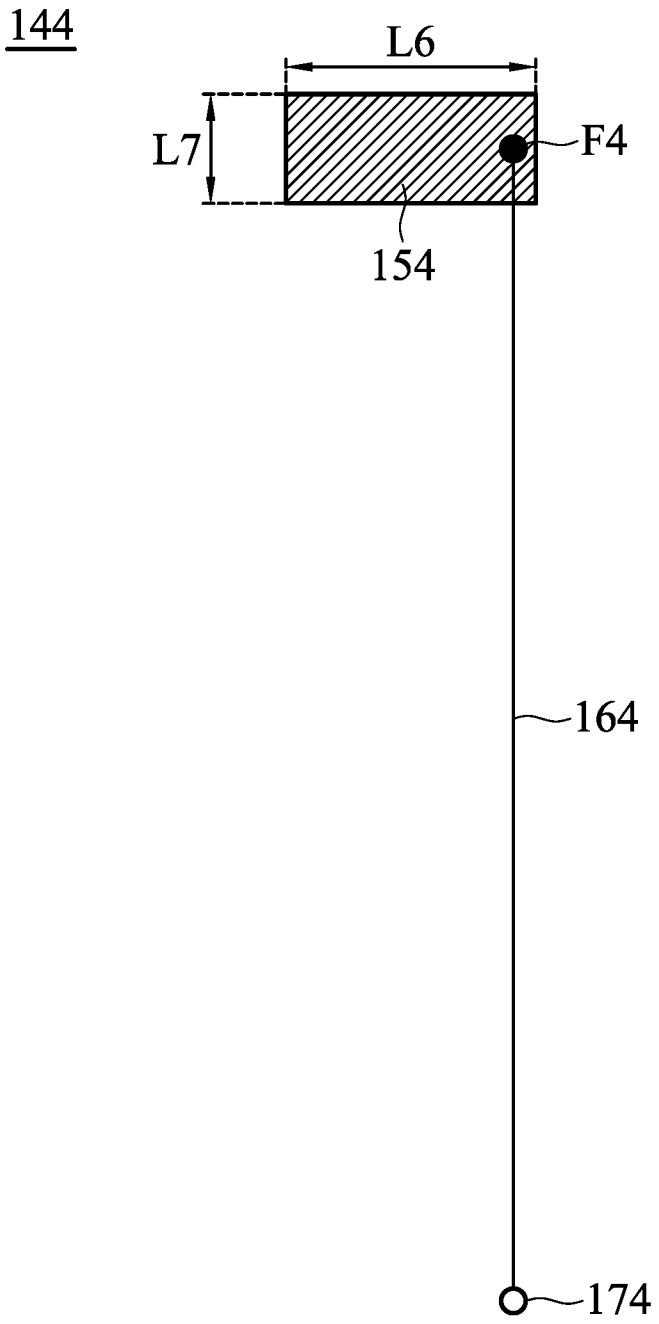
FIG. 5 is a diagram of an eighth antenna according to an embodiment of the invention.

FIG. 5 is a diagram of the eighth antenna 144 according to an embodiment of the invention. Please refer to FIG. 1A and FIG. 5 together. The eighth antenna 144 is disposed on an inner side surface of the third side wall 123 (i.e., the inner surface E4 of the housing 120). For example, the eighth antenna 144 may be substantially positioned above the third antenna 133, and the distance between the eighth antenna 144 and the third antenna 133 may be at least 50 mm. In the embodiment of FIG. 5, the eighth antenna 144 includes a fourth radiation element 154, a fourth connection line 164, and a fourth connector 174. The fourth radiation element 154 may be a rectangular metal piece. A fourth feeding point F4 may be substantially positioned at a shorter side of the rectangular metal piece. The fourth connection line 164 may be a coaxial cable. The fourth connector 174 may be an IPEX connector. The fourth feeding point F4 of the fourth radiation element 154 may be coupled through the fourth connection line 164 and the fourth connector 174 to metal traces on the dielectric substrate 110, so as to receive a feeding signal. With regard to element sizes, the length L6 of the longer side of the fourth radiation element 154 may be about 6.2 mm, the length L7 of the shorter side of the fourth radiation element 154 may be about 1.6 mm, and the length of the fourth connection line 164 may be from about 65 mm to about 75 mm. In some embodiments, the shortest distance between any two of the fifth antenna 141, the sixth antenna 142, the seventh antenna 143, and the eighth antenna 144 is at least 50 mm, so as to enhance the isolation between the antennas. For example, the aforementioned shortest distance may mean the distance D1 between the seventh antenna 143 and the sixth antenna 142, or the distance D2 between the seventh antenna 143 and the eighth antenna 144.

It should be noted that the above ranges of element sizes are calculated and obtained according to many experiment results, and they can help to optimize the operation frequency band and the impedance matching of each antenna.

In some embodiments, the four feeding points of the first antenna 131, the second antenna 132, the third antenna 133, and the fourth antenna 134 are respectively coupled to four independent low-frequency signal sources (e.g., four 2.4 GHz signal sources), and the four feeding points of the fifth antenna 141, the sixth antenna 142, the seventh antenna 143, and the eighth antenna 144 are respectively coupled to four independent high-frequency signal sources (e.g., four 5 GHz signal sources). In alternative embodiments, the four feeding points of the first antenna 131, the second antenna 132, the third antenna 133, and the fourth antenna 134 are all coupled to a single low-frequency signal source (e.g., a 2.4 GHz signal source), and the four feeding points of the fifth antenna 141, the sixth antenna 142, the seventh antenna 143, and the eighth antenna 144 are all coupled to a single high-frequency signal source (e.g., a 5 GHz signal source). Both of the above different feeding mechanisms can excite and generate the first frequency band and the second frequency band as above. The aforementioned low-frequency signal sources and high-frequency signal sources may be disposed on the dielectric substrate 110, and they may be further coupled through the metal traces formed on the dielectric substrate 110 (and/or connection lines) to the first antenna 131, the second antenna 132, the third antenna 133, the fourth antenna 134, the fifth antenna 141, the sixth antenna 142, the seventh antenna 143, and the eighth antenna 144.

According to practical measurements, the combination of all antennas of the communication device 100 of the invention can generate an almost omnidirectional radiation pattern on the XY-plane. The isolation between any adjacent two of the first antenna 131, the second antenna 132, the third antenna 133, and the fourth antenna 134 is higher than 15 dB. The ECC (Envelope Correlation Coefficient) between any adjacent two of the first antenna 131, the second antenna 132, the third antenna 133, and the fourth antenna 134 is smaller than 0.2. The gain of each of the first antenna 131, the second antenna 132, the third antenna 133, and the fourth antenna 134 is from 1 dBi to 5.7 dBi. On the other hand, the isolation between any adjacent two of the fifth antenna 141, the sixth antenna 142, the seventh antenna 143, and the eighth antenna 144 is higher than 20 dB. The ECC between any adjacent two of the fifth antenna 141, the sixth antenna 142, the seventh antenna 143, and the eighth antenna 144 is smaller than 0.1. The gain of each of the fifth antenna 141, the sixth antenna 142, the seventh antenna 143, and the eighth antenna 144 is from 1 dBi to 5.5 dBi. Therefore, the communication device 100 can meet the requirements of practical applications of general mobile communications.

The invention proposes a novel communication device with a novel antenna system. In comparison to the conventional design, the proposed antenna system has at least the advantages of dual frequency bands, omnidirectional radiation patterns, high isolation, and low ECC. Since the invention uses built-in antennas rather than conventional external antennas, the total size of the communication device can be further reduced. For example, the proposed communication device may have a length of about 80 mm, a width of about 80 mm, and a height of about 50 mm. Such a size is significantly smaller than that of a conventional 4×4 MIMO router (its length is about 290 mm, its width is about 270 mm, and its height is about 55 mm). In addition, the invention can prevent the appearance of the communication device from being negatively affected by the external antennas, so as to improve the whole device's appearance.

Note that the above element sizes, element shapes, and frequency ranges are not limitations of the invention. An antenna designer can fine-tune these settings or values according to different requirements. It should be understood that the communication device and the antenna system of the invention are not limited to the configurations of FIGS. 1-5. The invention may merely include any one or more features of any one or more embodiments of FIGS. 1-5. In other words, not all of the features displayed in the figures should be implemented in the communication device and the antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A communication device, comprising:

a dielectric substrate, having a top surface and a bottom surface;

a housing, having an outer surface and an inner surface;

a first antenna;

a second antenna;

a third antenna, wherein the first antenna and the third antenna are disposed on the top surface of the dielectric substrate;

a fourth antenna, wherein the second antenna and the fourth antenna are disposed on the bottom surface of the dielectric substrate;

a fifth antenna;

a sixth antenna;

a seventh antenna; and an eighth antenna, wherein the fifth antenna, the sixth antenna, the seventh antenna, and the eighth antenna are disposed on the inner surface of the housing;

wherein the first antenna, the second antenna, the third antenna, and the fourth antenna are substantially positioned at four vertices of a diamond shape;

wherein the shortest distance between any two of the first antenna, the second antenna, the third antenna, and the fourth antenna is at least 50 mm.

2. The communication device as claimed in claim 1, wherein the first antenna, the second antenna, the third antenna, and the fourth antenna cover a first frequency band from 2400 MHz to 2500 MHz, and wherein the fifth antenna, the sixth antenna, the seventh antenna, and the eighth antenna cover a second frequency band from 5150 MHz to 5850 MHz.

3. The communication device as claimed in claim 1, wherein the dielectric substrate substantially has a square shape.

4. The communication device as claimed in claim 3, wherein the first antenna, the second antenna, the third antenna, and the fourth antenna are respectively positioned at four sides of the dielectric substrate.

5. The communication device as claimed in claim 1, wherein the housing comprises a first side wall, a second side wall, a third side wall, and a fourth side wall, and wherein the dielectric substrate is surrounded by the first side wall, the second side wall, the third side wall, and the fourth side wall.

6. The communication device as claimed in claim 5, wherein the first side wall is adjacent to the first antenna, and wherein the fifth antenna is disposed on an inner side surface of the first side wall.

7. The communication device as claimed in claim 5, wherein the second side wall is adjacent to the second antenna.

8. The communication device as claimed in claim 5, wherein the third side wall is adjacent to the third antenna, and wherein the eighth antenna is disposed on an inner side surface of the third side wall.

9. The communication device as claimed in claim 5, wherein the fourth side wall is adjacent to the fourth antenna, and wherein the sixth antenna and the seventh antenna are disposed on an inner side surface of the fourth side wall.

10. The communication device as claimed in claim 5, wherein the seventh antenna is substantially positioned at a corner junction between the third side wall, the fourth side wall, and the dielectric substrate.

11. The communication device as claimed in claim 3, wherein the first antenna, the second antenna, the third antenna, and the fourth antenna are respectively positioned at four corresponding central points of four sides of the dielectric substrate.

* * * * *